US005096873A

United States Patent [19]

Minami et al.

[11] Patent Number: 5,096,873

[45] Date of Patent: Mar. 17, 1992

[54] THERMOSENSITIVE RECORDING SHEET

[75] Inventors: Toshiaki Minami; Tadakazu Fukuchi; Toshio Kaneko; Fumio Fujimura, all of Tokyo; Kazuto Tsukinuki, Nakatsu; Kazumi Saeki, Natsu; Akira Shimada, Nakatsu, all of Japan

[73] Assignees: Jujo Paper Co., Ltd., Tokyo; Yoshitomi Pharmaceutical Industries, Ltd., Osaka, both of Japan

[21] Appl. No.: 503,972

[22] Filed: Apr. 4, 1990

[30] Foreign Application Priority Data

Apr. 7, 1989 [JP] Japan ..... 1-89030

[51] Int. Cl.[5] ..... B41M 5/30

[52] U.S. Cl. ..... 503/216; 427/150; 503/217; 503/221; 503/225

[58] Field of Search ..... 427/150; 503/216, 217, 503/225, 221

[56] References Cited

FOREIGN PATENT DOCUMENTS 0056281 7/1982 European Pat. Off. ..... 503/216
0211968 3/1987 European Pat. Off. ..... 503/216

OTHER PUBLICATIONS

Patent Abstracts of Japan, vol. 10, No. 242 (M-509) (2298) Aug. 21, 1986 (Japanese Published Patent Appln. No. 61-72585).

Patent Abstracts of Japan, vol. 10, No. 37 (M-453) (2094) Feb. 14, 1986 (Japanese Published Patent Appln. No. 60-190386).

*Primary Examiner*—Bruce H. Hess

[57] ABSTRACT

A thermosensitive recording sheet comprising a support and a thermosensitive color developer layer thereon containing a basic leuco dye and an organic color developer, said layer containing a bis-phenyl sulfone compound selected from bis-(3-phenyl-4-hydroxyphenyl)-sulfone and bis-(2-methyl-4-hydroxy-5-cyclohexyl-phenyl)sulfone as the organic color developer.

5 Claims, No Drawings

THERMOSENSITIVE RECORDING SHEET

This invention relates to a thermosensitive recording sheet, and more specifically, to a thermosensitive recording sheet which is suitable for high-density and high-speed recording and has excellent image storage stability.

Thermosensitive recording sheets which utilize a coloring reaction under heat between a normally colorless or light-colored basic leuco dye and an organic color developer such as phenols and organic acids are disclosed, for example, in Japanese Patent Publication No. 14039/1970 and Japanese Laid-Open Patent Publication No. 27736/1973, and have gained widespread commercial acceptance. Generally, the thermosensitive recording sheets are obtained by grinding the colorless to light-colored basic leuco dye and the organic color developer into fine particles, mixing these particles, adding a binder, a filler, a sensitivity increasing agent, a lubricant and other auxiliary agents to the mixture to form a coating composition, and applying the coating composition in a thin layer to a support such as paper or a plastic film. The thermosensitive color developer layer forms a color imagewise by an instantaneous chemical reaction induced by heating and thereby permits recording of the image. Images of various colors can be obtained by properly selecting the type of the leuco dye.

These thermosensitive recording sheets have been finding applications, for example, in measuring and recording instruments in the medical or industrial field, terminal devices of computers and information communication devices, facsimile devices, printers of electronic portable calculators, automatic ticket vendors, bar cord labels, etc.

In recent years, the thermosensitive recording method has gained widespread acceptance and found a diversity of applications, and it has been considered important to increase not only the speed of recording but also the density of recording for higher resolution or enhanced image quality. As a result, the thermal energy of a thermal printhead in a recording device tends to become increasingly low, and therefore, thermosensitive recording sheets used in it are required to have color forming sensitivity sufficient to obtain clear recorded color images even when the amount of thermal energy is low. On the other hand, thermosensitive recording sheets having excellent storage stability such as water resistance and oil resistance are required.

In the past, bisphenol A, p-hydroxybenzoate esters and bis-(4-hydroxyphenyl)sulfones have been used as color developers for leuco dyes. However, these phenols have a high color-formation density but the formed images lack storage stability. Accordingly, their density decreases on spontaneous standing, and their density decreases when finger prints, etc. contact oils and fats and a plasticizer. For example, Japanese Laid-Open Patent Publication No. 27991/1989 proposes the use of bis(3-chloro-4-hydroxyphenyl)sulfone as a color developer which gives an image of good stability. An image obtained by using this compound as a color developer has excellent oil resistance and plasticizer resistance, but since its water resistance is very inferior, its application to a thermosensitive recording material is virtually difficult. The present applicant suggested in Japanese Laid-Open Patent Publication No. 230983/1986 that the use of bis(3-tertiary butyl-4-hydroxy-6-methylphenyl)sulfone as a color former would give a thermosensitive recording sheet having excellent storage property of a colored image. It has been found however that the image in this case is stabilized, but backgrounding coloration in the early stage and with the passage of time decreases.

To date, therefore, no thermosensitive recording sheet has been obtained which satisfies all of the color formability, water resistance, oil resistance and backgrounding coloration.

It is a primary object of this invention to provide a thermosensitive recording sheet which is suitable for high density recording at high speed.

Other objects of the invention along with its features will become apparent from the following description.

According to the invention, there is provided a thermosensitive recording sheet comprising a support and a thermosensitive color developer layer thereon containing a basic leuco dye and an organic color developer, said layer containing a bis-phenylsulfone compound selected from bis-(3-phenyl-4-hydroxyphenyl)sulfone and bis-(2-methyl-4-hydroxy-5-cyclohexylphenyl)sulfone as the organic color developer.

The main feature of the present invention is that at least one organic color developer selected from (A) bis-(3-phenyl-4-hydroxyphenyl)sulfone and (B) bis-(2-methyl-4-hydroxy-5-cyclohexylphenyl)sulfone is used in the thermosensitive color developer layer.

The bis-(4-hydroxyphenyl)sulfones (A) and (B) are novel and not described in the prior literature. They may be produced, for example, by oxidizing the corresponding bis(4-hydroxyphenyl)sulfide compounds using, for example, hydrogen peroxide, peracid, hydroperoxide, ozone, oxygen and a transition metal catalyst, potassium peroxosulfate, potassium permanganage, chromic acid, sodium hypochloride, nitric acid, dinitrogen tetroxide, sodium metaperiodate, ruthenium oxide and osmium (VIII) oxide.

The oxidation reaction may generally be carried out advantageously by using 0.5 to 10 equivalents of the oxidizing agent per mole of the sulfide compound at a temperature of $-70°$ to $100°$ C. Specific production methods of the compounds (A) and (B) are described in detail in Synthesis Examples 1 and 2.

The compounds (A) and/or (B) used in the organic color developer in this invention have the advantage that they have a very high rate of melting or dissolving diffusion and a very high saturation solubility with respect to the basic leuco dyes used in the thermosensitive recording layer. Accordingly, the compounds (A) and/or (B) as color developers react rapidly on heating with basic leuco dyes to form a colored composition. In addition, it has been found that this colored composition is very stable to water, a plasticizer and oils and fats. As a result, the present invention can provides a thermosensitive recording material which is suitable for high density and high speed recording and has excellent color formability, water resistance, oil resistance, thermal response, and storage stability of the colored image.

The compounds (A) and/or (B) as color developers which lead to the above advantages is conveniently used in an amount of generally 1 to 12 parts by weight, preferably 2 to 6 parts by weight, more preferably 3 to 4 parts by weight, per part by weight of the basic leuco dye in the thermosensitive color developer layer.

The "basic leuco dye" used in the thermosensitive recording sheet of this invention is a basic dye having the property of being normally colorless or light-colored but upon contact with the aforesaid color developers under heat, forming a color. There is no particular restriction on the basic leuco dye used in this invention and any basic leuco dyes heretofore used in thermosensitive recording sheets can equally be used. Generally, leuco dyes of the triphenylmethane, fluorane and azaphthalide types are preferred. Specific examples are shown Triphenylmethane-type leuco dyes 3,3-bis(p-Dimethylaminophenyl)-6-dimethylaminophthalide (also called Crystal Violet Lactone).

Fluorane-type leuco dyes

3-Diethylamino-6-methyl-7-anilinofluorane,
3-(N-ethyl-p-toluidino)-6-methyl-7-anilino-fluorane,
3-(N-ethyl-N-isoamyl)amino-6-methyl-7-anilino-fluorane,
3-diethylamino-6-methyl-7-(o,p-dimethyl-anilino)-fluorane,
3-pyrolidino-6-methyl-7-anilinofluorane,
3-piperidino-6-methyl-7-anilinofluorane,
3-(N-cyclohexyl-N-methylamino)-6-methyl-7-anilinofluorane,
3-diethylamino-7-(m-trifluoromethylanilino)-fluorane,
3-N-n-dibutylamino-7-(o-chloroanilino)fluorane,
3-(N-ethyl-N-tetrahydrofurylamino)-6-methyl-7-anilinofluorane,
3-dibutylamino-6-methyl-7-(o,p-dimethyl-anilino)-fluorane,
3-(N-methyl-N-propylamino)-6-methyl-7-anilinofluorane,
3-diethylamino-6-chloro-7-anilinofluorane,
3-dibutylamino-7-(o-chloroanilino)fluorane,
3-diethylamino-6-methyl-chlorofluorane,
3-diethylamino-6-methyl-fluorane,
3-cyclohexylamino-6-chlorofluorane,
3-diethylamino-7-(o-chloroanilino)fluorane, and
3-diethylamino-benzoa)-fluorane.

Azaphthalide-type leuco dyes 3-(4-Diethylamino-2-ethoxyphenyl)-3-(1-ethyl-2-methylindol-3-yl)-4-azaphthalide,
3-(4-diethylamino-2-ethoxyphenyl)-3-(1-ethyl-2-methylindol-3-yl)-7-azaphthalide,
3-(4-diethylamino-2-ethoxyphenyl)-3-(1-octyl-2-methylindol-3-yl)-4-azaphthalide, and
3-(4-N-cyclohexyl-N-methylamino-2-methoxyphenyl)-3-(1-ethyl-2-methylindol-3-yl)-4-azaphthalide.

Fluorene-type leuco dyes 3,6,6'-tris(dimethylamino)spirofluorene-9,3'-phthalide), and
3,6,6'-tris(diethylamino)spiro[fluorene-9,3'-phthalide].

Of the basic leuco dyes described above, triphenylmethane-type, fluorane-type dyes and fluorene-type dyes are preferred. These dyes may also be used singly or in combination. In the present invention, a thermosensitive recording sheet having a markedly high dynamic image density can be obtained by using 3-diethylamino-6-methyl--anilinofluorane, 3-(N-cyclohexyl-N-methylamino)-6-methyl-7-anilinofluorane and 3-(N-ethyl-N-isoamyl)amino--methyl-7-anilinofluorane singly as the basic leuco dye.

The thermosensitive color developer layer in accordance with this invention may contain, in addition to the compounds (A) and (B), at least one another organic color developer whose type and amount does not substantially adversely affect the effects of this invention.

The organic color developers that can be used in combination with the compound (A) and/or (B) above in the thermosensitive color developing layer in accordance with this invention may be any organic color developer heretofore used in the thermosensitive color developing layer of a thermosensitive recording sheet. Examples include bisphenol A compounds, 4-hydroxybenzoic acid esters, 4-hydroxyphthalic acid diesters, phthalic acid monoesters, bis-(hydroxyphenyl) sulfides, 4-hydroxy-phenylarylsulfones, 4-hydroxyphenylarylsulfonates, 1,3-di2-(hydroxyphenyl)-2-propyl] benzenes, 4-hydroxy-benzoyloxybenzoic acid esters, bisphenolsulfones, and other color developers. Specific examples are given bis-Phenol A compounds 4,4'-Isopropylidene diphenol (also called bisphenol A),
4,4'-cyclohexylidene diphenol, and
p,p'-(1-methyl-n-hexylidene)diphenol.

4-Hydroxybenzoates

Benzyl 4-hydroxybenzoate,
ethyl 4-hydroxybenzoate,
propyl 4-hydroxybenzoate,
isopropyl 4-hydroxybenzoate,
butyl 4-hydroxybenzoate,
isobutyl 4-hydroxybenzoate, and
methylbenzyl 4-hydroxybenzoate.

4-Hydroxyphthalic acid diesters

Dimethyl 4-hydroxyphthalate,
diisopropyl 4-hydroxyphthalate,
dibenzyl 4-hydroxyphthalate, and
dihexyl 4-hydroxyphthalate.

Phthalic acid monoesters

Monobenzyl phthalate,
monocyclohexyl phthalate,
monophenyl phthalate,
monomethylphenyl phthalate,
monoethylphenyl phthalate,
monoalkylbenzyl phthalates,
monohalobenzyl phthalates, and
monoalkoxybenzyl phthalates bis-(Hydroxyphenyl)sulfides bis-(4-Hydroxy-3-tert-butyl-6-methylphenyl)-sulfide,
bis-(4-hydroxy-2,5-di-methylphenyl)sulfide,
bis-(4-hydroxy-2-methyl-5-ethylphenyl)sulfide,
bis-(4-hydroxy-2-methyl-5-isopropylphenyl)-sulfide,
bis-(4-hydroxy-2,3-dimethylphenyl)sulfide,
bis-(4-hydroxy-2,5-diethylphenyl)sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)-sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide, and
bis-(4-hydroxy-2-tert-octyl-5-methylphenyl)-sulfide.

4-Hydroxyphenyl arylsulfones 4-hydroxy-4'-isopropoxydiphenylsulfone,
4-hydroxy-4'-methyldiphenylsulfone, and 4-hydroxy-4'-n-butyloxydiphenylsulfone.

4-Hydroxyphenyl arylsulfonates

4-Hydroxyphenyl benzenesulfonate,
4-hydroxyphenyl p-tolylsulfonate,
4-hydroxyphenyl mesitylenesulfonate,
4-hydroxyphenyl p-chlorobenzenesulfonate,
4-hydroxyphenyl p-tert-butylbenzenesulfonate,
4-hydroxyphenyl p-isopropoxybenzenesulfonate,
4-hydroxyphenyl 1'-naphthalenesulfonate, and
4-hydroxyphenyl 2'-naphthalenesulfonate.

1,3-Di[2-(hydroxyphenyl)-2-propyl]benzenes 1,3-Di2-(4-hydroxyphenyl)-2-propyl]benzene,
1,3-di[2-(4-hydroxy-3-alkylphenyl)-2-propyl]-benzene,
1,3-di[2-(2,4-dihydroxyphenyl)-2-propyl]-benzene, and
1,3-di[2-(2-hydroxy-5-methylphenyl)-2-propyl]-benzene.

Resorcinols 1,3-Dihydroxy-6(alpha,alpha-dimethylbenzyl)-benzene.

4-Hydroxybenzoyloxybenzoic acid esters

Benzyl 4-hydroxybenzoyloxybenzoate,
methyl 4-hydroxybenzoyloxybenzoate,
ethyl 4-hydroxybenzoyloxybenzoate,
propyl 4-hydroxybenzoyloxybenzoate,
butyl 4-hydroxybenzoyloxybenzoate,
isopropyl 4-hydroxybenzoyloxybenzoate,
tert-butyl 4-hydroxybenzoyloxybenzoate,
hexyl 4-hydroxybenzoyloxybenzoate,
octyl 4-hydroxybenzoyloxybenzoate,
nonyl 4-hydroxybenzoyloxyenzoate,
cyclohexyl 4-hydroxybenzoyloxybenzoate,
beta-phenethyl 4-hydroxybenzoyloxybenzoate,
phenyl 4-hydroxybenzoyloxybenzoate,
alpha-naphthyl 4-hydroxybenzoyloxybenzoate,
beta-naphthyl 4-hydroxybenzoyloxybenzoate, and
sec-butyl 4-hydroxybenzoyloxybenzoate.

bis-Phenolsulfones (I)

bis-(3-1-butyl-4-hydroxy-6-methylphenyl)-sulfone,
bis-(3-ethyl-4-hydroxyphenyl)sulfone,
bis-(3-propyl-4-hydroxyphenyl)sulfone,
bis-(3-methyl-4-hydroxyphenyl)sulfone,
bis-(2-isopropyl-4-hydroxyphenyl)sulfone,
bis-(2-ethyl-4-hydroxyphenyl)sulfone,
bis-(3-chloro-4-hydroxyphenyl)sulfone,
bis-(2,3-dimethyl-4-hydroxyphenyl)sulfone,
bis-(2,5-dimethyl-4-hydroxyphenyl)sulfone,
bis-(3-methoxy-4-hydroxyphenyl)sulfone,
4-hydroxyphenyl-2'-ethyl-4'-hydroxyphenylsulfone,
4-hydroxyphenyl-2'-isopropyl-4'-hydroxyphenylsulfone,
4-hydroxyphenyl-3'-isopropyl-4'-hydroxyphenylsulfone,
4-hydroxyphenyl-3'-sec-butyl-4'-hydroxyphenylsulfone,
3-chloro-4-hydroxyphenyl-3'-isoprop-yl-4'-hydroxyphenylsulfone,
2-hydroxy-5-t-butylphenyl-4'-hydroxyphenylsulfone,
2-hydroxy-5-t-aminophenyl-4'-hydroxyphenylsulfone,
2-hydroxy-5-isopropylphenyl-4'-hydroxyphenylsulfone,
2-hydroxy-5-t-octylphenyl-4'-hydroxyphenylsulfone,
2-hydroxy-5-t-butylphenyl-3'-chloro-4'-hydroxyphenylsulfone,
2-hydroxy-5-t-butylphenyl-3'-methyl-4'-hydroxyphenylsulfone,
2-hydroxy-5-t-butylphenyl-3'-isopropyl-4'-hydroxyphenylsulfone,
2-hydroxy-5-t-butylphenyl-3'-chloro-4'-hydroxyphenylsulfone,
2-hydroxy-5-t-butylphenyl-3'-methyl-4'-hydroxyphenylsulfone,
2-hydroxy-5-t-butylphenyl-3'-isopropyl-4'-hydroxyphenylsulfone, and
2-hydroxy-5-t-butylphenyl-2'-methyl-4'-hydroxyphenylsulfone.

bis-Phenolsulfones (II)

4,4'-Sulfonyldiphenol,
2,4'-sulfonyldiphenol,
3,3'-dichloro-4,4'-sulfonyldiphenol,
3,3'-dibromo-4,4'-sulfonyldiphenol,
3,3',5,5'-tetrabromo-4,4'-sulfonyldiphenol, and
3,3'-diamino-4,4'-sulfonyldiphenol.

Others p-tert-Butylphenol,
2,4-dihydroxybenzophenone,
novolak-type phenolic resins,
4-hydroxyacetophenone,
p-phenylphenol,
benzyl-4-hydroxyphenylacetate, and
p-benzylphenol.

Other organic color developers which can be used preferably in combination with the compounds (A) and/or (B) include benzyl 4-hydroxybenzoate, 4-hydroxyphenyl 2'-naphthalenesulfonate, 4,4'-isopropylidene diphenol and 4-hydroxy-4'-isopropoxydiphenylsulfone.

When the other organic color developer is to be used in combination with the compounds (A) and/or (B), its amount is not critical and can be varied depending the type of the leuco dye and the type of the color developer. Generally, the weight ratio of the compound (A) and/or (B) to the other organic color developer is desirably from 1/1 to 10/1, preferably from 5/2 to 5/1.

The color developer and the basic leuco dye are reduced to fine particles having a particle diameter of less than several microns by a grinding machine such as a ball mill, an attriter or a sand grinder., or a suitable emulsifying device, and according to the purpose for which the final product is used, a binder, a-sensitizer and various additives may be added. The resulting coating composition is coated on a substrate such as paper or a plastic film, and dried to form a thermosensitive recording layer whose amount of coating is 4 to 10 $g/m^2$ (in a dry condition). As a result, the thermosensitive recording sheet of this invention can be obtained.

Suitable binders that can be used in this invention include, for example, completely saponified polyvinyl alcohol having a degree of polymerization of 200 to 1900, partially saponified polyvinyl alcohol, carboxy-modified polyvinyl alcohol, amide-modified polyvinyl alcohol, sulfonic acid-modified polyvinyl alcohol, butyral-modified polyvinyl alcohol, other modified polyvinyl alcohols, hydroxyethyl cellulose, methyl cellulose, carboxymethyl cellulose, styrene/maleic anhydride copolymer, styrene/butadiene copolymer, cellulose derivatives (e.g, ethyl cellulose and acetyl cellulose), polyvinyl chloride, polyvinyl acetate, polyacrylamide, polyacrylates, polyvinylbutyral, polystyrol, copolymers of these, polyamide resins, silicone resins, petroleum resins, terpene resins, ketone resins and coumarone resins. These polymeric binders can be used as solutions in water, alcohols, ketones, esters and hydrocarbons, or as emulsions or pastes dispersed in water or other media, according to the required qualities. The suitable amount of the binder is generally 8 to 20 % by weight, preferably 9 to 15 % by weight, more preferably 10 to 13 % by weight based on the total solid content.

Furthermore, a sensitizer normally may be included in the thermosensitive color developer layer in accordance with the invention. Examples of the sensitizer include fatty acid amides such as stearamide and paltitamide, ethylene bisamide, montan waxes, polyethylene waxes, dibenzyl terephthalate, benzyl p-benzyl-oxybenzoate, di-p-tolyl carbonate, p-benzyl biphenyl, phenyl alpha-naphthylcarbonate, 1,4-diethoxynaphthalene, phenyl 1-hydroxy-2-naphthoate, 1,2-di-(3-methylphenoxy)-ethane, bis2-(4-methoxyphenoxy)ethane, bis[2-(4-methoxy-ph-enoxy)ethyl)ether, dibenzyl-4,4'-ethylenedioxy dibenzoate and m-terphenyl. They may be used singly or in combination. The amount of the sensitizer used is not critical and can be varied depending upon its type. It is generally 0.2 to 5 parts by weight, preferably 0.4 to 3 parts by weight, especially preferably 0.5 to 2.5 parts by weight, per part by weight of the basic leuco dye.

The additive which can also be blended with the basic leuco dye and the color developer may be those which are used in conventional thermosensitive recording sheets Examples include inorganic or organic fillers such as fine particles of clay, talc, silica, magnesium carbonate, alumina, aluminum hydroxide, magnesium hydroxide, barium sulfate, kaolin, titanium oxide, zinc oxide, calcium carbonate, aluminum oxide, urea, formalin resins, polystyrene and phenol resins, which are used usually in paper finishing; mold-releasing agents such as fatty acid metal salts; lubricants for preventing pressure coloration, such as fatty acid amides, ethylene bisamide, montan waxes and polyethylene waxes; dispersing agents such as sodium hexametaphosphate, sodium polycarboxylates, sodium dioctylsulfosuccinate, sodium dodecylbenzenesulfonate, sodium laurate, sodium salt of lauryl sulfate and alginate; ultraviolet absorbers such as benzophenone compounds and triazole compounds; water proofing agents such as glyoxal; defoamers such as acetylene glycol; flourescent bleaching agents; and stabilizers such as phthalic acid monoester metal salts, p-tertiary butyl-benzoic acid metal salts and nitrobenzoic acid metal salts. The amounts of these additives are determined depending upon the properties required of the product, its recording suitability, etc., and are not particularly restricted. As tentative standards, the amount of the fillers is, for example, 1 to 20 parts by weight per part by weight of the leuco dye. The other components may be used in amounts normally used.

For the purpose of increasing storage stability, an overcoat layer of a polymer etc. may be provided on the thermosensitive color-forming layer.

The characteristics and advantage of the thermosensitive recording sheet of this invention are as follows:

(1) Because of its excellent thermal response characteristics, it can give clear images of high density even in high-speed high-density recording (high sensitivity).

(2) Even upon contact with a plasticizer, salad oil, vinegar, etc., the printed portion (colored portion) scarcely fades (oil resistance).

(3) Even on contact with water, the printed portion scarcely fades (water resistance).

(4) Under high temperature conditions, the background remains stable (white sheet storage stability).

The following examples illustrate the present invention specifically. All parts in these examples are by weight.

SYNTHESIS EXAMPLE 1

Synthesis of bis-(3-phenyl-4-hydroxyphenyl)-sulfone:

Five grams of bis-(3-phenyl-4phydroxyphenyl)-sulfide was dissolved in 30 ml of glacial acetic acid, and 27.5 ml of 30% aqueous hydrogen peroxide was added. With stirring, the mixture solution was boiled for 2 hours to complete the reaction. After cooling, 100 ml of ether was added to the reaction mixture to extract it. The ether layer was neutralized with a 5% aqueous solution of sodium hydrogen carbonate, washed with water, and dried over an hydrous sodium sulfate. The ether was removed, and the residue was concentrated under reduced pressure to give pale yellow crystals. Recrystalization of the crystals from ether/hexane gave colorless crystals. Yielded amount: 5.1 g; mp. 243–245° C.

SYNTHESIS EXAMPLE 2

Synthesis of bis-(2-methyl-4-hydroxy-5-cyclohexylphenyl)sulfone:

Five grams of bis-(2-methyl-4-hydroxy-5-cyclohexylphenyl)sulfide was dissolved in 40 ml of glacial acid, and 27.5 ml of 30% aqueous hydrogen peroxide was added. With stirring, the mixture was boiled for 2 hours to complete the reaction. After cooling, 100 ml of ether was added to the reaction mixture to extract it. The ether layer was neutralized with a 5% aqueous solution of sodium hydrogen carbonate, then washed with water and dried over anhydrous sodium sulfate. The ether was removed and the residue was concentrated under reduced pressure to give pale yellow crystals. Recrystalization of the crystals from ether/hexane gave colorless crystals. Yielded amount 5.2 g, mp. 300–301° C.

EXAMPLES 1 AND 2 (Tests Nos. 1 and 2)

Production of a thermosensitive recording sheet:

| | |
|---|---|
| Dye dispersion A | |
| 3-(N-ethyl-N-isoamylamino)-6-methyl-7-anilinofluorane | 2.0 parts |
| 10% aqueous polyvinyl alcohol solution | 4.6 parts |
| water | 2.5 parts |
| Color developer dispersion B | |
| Color developer (see Table 1) | 6 parts |
| 10% aqueous polyvinyl alcohol solution | 18.8 parts |
| Water | 11.2 parts |

The above dispersions A and B were individually grounds to particles with a size of 1 microns by means of a sand grinder, and then mixed in the following proportions to form a coating solution.

| | |
|---|---|
| Dye dispersion A | 9.1 parts |
| Color developer dispersion B | 36 parts |

-continued

| | |
|---|---|
| Kaolin clay (50% dispersion) | 12 parts |

The coating solution having a basis weight of 50 g/m$^2$ was coated on one surface of a substrate sheet at a rate of 6.0 g/m$^2$, and dried. The sheet was supercalendered to a degree of smoothness of 400 to 500 seconds to obtain a black coloring thermosensitive recording sheets.

COMPARATIVE SAMPLES 1-7 (Tests Nos. 3-9)

| Color developer dispersion C | |
|---|---|
| Color developer (see Table 1) | 6 parts |
| 10% aqueous polyvinyl alcohol solution | 18.8 parts |
| Water | 11.2 parts |

Examples 1 and 2 were repeated except that the color developer dispersion C was used instead of the color developer dispersion B.

The thermosensitive recording sheets obtained in the above Examples and Comparative Examples were subjected to the following quality tests. The results are shown in Table 1.

(*4) Oil resistance

By using A thermosensitive facsimile KB-4900 SD(made by Tokyo Shibaura Electric Co., Ltd.), an image was recorded at an applied voltage of 18.03 V with a pulse width of 3.2 milliseconds. The image density was measured by a Macbeth densitometer (RD-914 having an amber filter). The obtained density was designated as the non-treated image density. Castor oil was added dropwise onto the printed colored portion, and 10 seconds later, it was wiped off lightly with filter paper. After standing at room temperature for 3 days, the color density was measured by a Macbeth densitometer. The residual ratio was calculated in accordance with the following equation.

$$\text{Residual ratio} = \frac{\text{Color density after oil treatment}}{\text{Untreated color density}} \times 100(\%)$$

(*5) Water resistance

The sample of thermosensitive recording sheet which was dynamically recorded by the method described in (*3) was immersed in cold water at 20° C. for 64 hours, and then dried. Then, the recorded portion was measured by a Macbeth densitometer.

TABLE 1

| | Test No. | Color developer | Coloration density (*1) Static (*2) | Coloration density (*1) Dynamic (*3) | Oil resistance (*4) Non-treated | Oil resistance (*4) Treated | Oil resistance (*4) Residue ratio | Water resistance (*5) Non-treated | Water resistance (*5) Treated | Water resistance (*5) Residue ratio | White sheet storage stability (*6) Non-treated | White sheet storage stability (*6) Treated |
|---|---|---|---|---|---|---|---|---|---|---|---|---|
| Example | 1 | bis-(3-phenyl-4-hydroxyphenyl)sulfone | 1.23 | 1.12 | 1.12 | 1.10 | 98 | 1.12 | 1.06 | 95 | 0.06 | 0.07 |
| | 2 | bis-(2-methyl-4-hydroxy-5-cyclohexylphenyl)-sulfone | 1.22 | 1.11 | 1.11 | 1.08 | 97 | 1.11 | 1.06 | 95 | 0.06 | 0.07 |
| Comparative Example | 3 | bis-(3-tertiary butyl-4-hydroxy-6-methyl-phenyl) sulfone | 1.20 | 1.10 | 1.10 | 0.97 | 88 | 1.10 | 0.93 | 85 | 0.08 | 0.12 |
| | 4 | bis-(3-chloro-4-hydroxyphenyl)sulfone | 1.15 | 1.05 | 1.05 | 0.84 | 80 | 1.05 | 0.73 | 70 | 0.08 | 0.13 |
| | 5 | tetrabromo bisphenol S | 1.14 | 1.04 | 1.04 | 0.78 | 75 | 1.04 | 0.67 | 64 | 0.09 | 0.13 |
| | 6 | bisphenol S | 1.14 | 1.03 | 1.03 | 0.72 | 70 | 1.03 | 0.61 | 59 | 0.09 | 0.12 |
| | 7 | bis-(3-tertiary-butyl-4-hydroxyphenyl)sulfone | 1.15 | 1.02 | 1.02 | 0.66 | 65 | 1.02 | 0.61 | 60 | 0.08 | 0.14 |
| | 8 | bis-(3-allyl-4-hydroxyphenyl)sulfone | 1.15 | 1.05 | 1.05 | 0.79 | 75 | 1.05 | 0.67 | 64 | 0.08 | 0.14 |
| | 9 | bisphenol A | 0.19 | 0.81 | 0.81 | 0.62 | 77 | 0.81 | 0.26 | 32 | 0.08 | 0.15 |

Notes to Table 1

(*1) Coloration density: measured by Macbeth densitometer (RD-914 having an amber filter)

(*2) Static image density

The recording sheet was pressed against a hot plate heated at 105° C. under a pressure of 10 g/cm$^2$for 5 seconds, and the density of the formed color was maintained by a Macbeth densitometer.

(*3) Dynamic image density

The density of an image recorded on the recording sheet at an applied voltage of 18.3 V with a pulse width of 3.2 milliseconds using a thermosensitive facsimile KB-4800 made by Tokyo Shibaura Electric Co., Ltd. was measured by a Macbeth densitometer.

The residual ratio was calculated by the following equation.

$$\text{Residual ratio} = \frac{\text{Color density after treatment with water}}{\text{Untreated color density}} \times 100(\%)$$

(*6) White sheet storage stability (background coloration)

An uncolored sample was allowed to stand for 24 hours at a high temperature of 60° C. under drying conditions. Then, the density of backgrounding was measured by a Macbeth densitometer.

What we claim:

1. A thermosensitive recording sheet comprising a support and a thermosensitive color developer layer thereon containing a basic leuco dye and an organic color developer, said layer containing a bis-phenyl sulfone compound which is bis-(2-methyl-4-hydroxy-5-cyclohexylpheny)sulfone as the organic color developer.

2. The thermosensitive recording sheet of claim 1 wherein the amount of the bis-phenyl sulfone compound is 1 to 12 parts by weight per part by weight of the basic leuco dye.

3. The thermosensitive recording sheet of claim 2 wherein the amount of the bis-phenyl sulfone compound is 2 to 6 parts by weight per part by weight of the basic leuco dye.

4. The thermosensitive recording sheet of claim 1 wherein the basic leuco dye is selected from triphenylmethane dyes, fluorane dyes and fluorene dyes.

5. The thermosensitive recording sheet of claim 1 wherein the basic leuco dye is selected from 3-diethylamino-6-methyl-7-aniliniofluorane, 3-(N-cyclohexyl-N-methylamino)-6-methyl-7-anilinofluorane and 3-(N-ethyl-N-isoamyl)amino-6-methyl-7-anilinofluorane.

* * * * *